US007709723B2

(12) United States Patent
Pachet et al.

(10) Patent No.: US 7,709,723 B2
(45) Date of Patent: May 4, 2010

(54) MAPPED META-DATA SOUND-PLAYBACK DEVICE AND AUDIO-SAMPLING/SAMPLE-PROCESSING SYSTEM USABLE THEREWITH

(75) Inventors: François Pachet, Paris (FR); Jean-Julien Aucouturier, Paris (FR)

(73) Assignee: Sony France S.A., Clichy la Garenne (FR)

( * ) Notice: Subject to any disclaimer, the term of this patent is extended or adjusted under 35 U.S.C. 154(b) by 859 days.

(21) Appl. No.: 11/243,003

(22) Filed: Oct. 4, 2005

(65) Prior Publication Data

US 2006/0074649 A1 Apr. 6, 2006

(30) Foreign Application Priority Data

Oct. 5, 2004 (EP) ..... 04292365

(51) Int. Cl.
*G10H 7/00* (2006.01)

(52) U.S. Cl. ..... 84/603; 84/600; 84/609; 84/616; 84/623; 84/627; 84/645

(58) Field of Classification Search ..... 84/600, 84/603, 609, 616, 623, 627, 645
See application file for complete search history.

(56) References Cited

U.S. PATENT DOCUMENTS 4,688,464 A * 8/1987 Gibson et al. ..... 84/454
5,208,861 A * 5/1993 Fujii ..... 704/208
5,315,057 A * 5/1994 Land et al. ..... 84/601
5,536,902 A * 7/1996 Serra et al. ..... 84/623
5,945,986 A * 8/1999 Bargar et al. ..... 715/236

(Continued)

FOREIGN PATENT DOCUMENTS

EP 0 600 639 6/1994

(Continued)

OTHER PUBLICATIONS

Eric D. Scheirer, "Tempo and beat analysis of acoustic musical singals", Machine Listening Group, E15-401D MIT Media Laboratory, Cambridge, Massachusetts 02139, (Received Dec. 27, 1996; revised Aug. 26, 1997; accepted Sep. 15, 1997).*

(Continued)

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

Audio samples corresponding to audio extracts or whole audio titles are automatically mapped to triggers 12 in a playable sound-producing device 1, the mapping being dependent on the meta-data associated with the audio samples. Thus, a user can play the sound-producing device and generate sounds derived from his favorite audio titles. It is possible to define different mappings between the audio samples and the playable domain of the sound-producing device: an audio sample selector 50 can select between different possible samples for playback by comparing the audio properties of the samples and the play-mode and/or characteristics of the user's performance. An audio sampler/sample-processor 70 can automatically extract segments of an audio source file and map them to triggers in the sound-producing device 1.

9 Claims, 8 Drawing Sheets

U.S. PATENT DOCUMENTS

| | | | | |
|---|---|---|---|---|
| 5,952,599 | A * | 9/1999 | Dolby et al. | 84/649 |
| 6,008,446 | A | 12/1999 | Van Buskirk et al. | |
| 6,274,799 | B1 * | 8/2001 | Shimizu | 84/622 |
| 6,380,473 | B2 * | 4/2002 | Uehara | 84/609 |
| 6,448,486 | B1 * | 9/2002 | Shinsky | 84/613 |
| 6,924,425 | B2 * | 8/2005 | Naples et al. | 84/609 |
| 2002/0152875 | A1 | 10/2002 | Hughes et al. | |
| 2003/0159567 | A1 * | 8/2003 | Subotnick | 84/626 |
| 2004/0173082 | A1 * | 9/2004 | Bancroft et al. | 84/612 |
| 2005/0275637 | A1 * | 12/2005 | Hinckley et al. | 345/173 |
| 2006/0107823 | A1 * | 5/2006 | Platt et al. | 84/616 |
| 2006/0278065 | A1 * | 12/2006 | Ramstein | 84/645 |

FOREIGN PATENT DOCUMENTS

| | | |
|---|---|---|
| EP | 1 431 956 | 6/2004 |

OTHER PUBLICATIONS

Tristan Jehan, "Creating Music by Listening" (XP-002464414), Doctor of Philosophy at the MIT Sep. 2005.*

Zils A et al: "Automatic extraction of drum tracks from polyphonic music signals" Proceedings of the Second International Conference on Web Delivering of Music -Wedelmusic'02- Dec. 9, 2002, pp. 179-183, XP010626960.

* cited by examiner

| Sample No. | Audio Sample Data | | | | | ADSR Data | | | Stability Data | | | | | | | | Descriptors | | | | | Key Assignment | |
|---|---|---|---|---|---|---|---|---|---|---|---|---|---|---|---|---|---|---|---|---|---|---|---|
| | Byte 0 | Byte 1 | Byte 2 | ... | Byte n | DSB | SSB | RSB | SZ1 SB | SZ1 EB | SZ1 ST. | SZ2 SB | SZ2 EB | SZ2 ST | ... | SZm ST | Pitch/NN | Energy | Noise | Percuss | Timbre | C6 | C5 |

MAPPED META-DATA SOUND-PLAYBACK DEVICE AND AUDIO-SAMPLING/SAMPLE-PROCESSING SYSTEM USABLE THEREWITH

The present invention relates to the field of sample-based sound-producing devices or systems, for example, sample-based artificial musical instruments, computer systems including sound cards, etc. More particularly, the present invention relates to devices or systems which produce sound by playing back an audio sample. The invention also relates to a new system for sampling and processing audio for playback in such a system.

Artificial musical instruments and "synthesizers" have been in use for many years and take different physical forms (digital organ, keyboard-type synthesizer, computer system, etc.). They can be software- or hardware-based, or a mixture of the two.

In the 1980s, sample-based synthesizers (often designated "samplers") were introduced, in which sounds of desired pitch were produced by playing back pre-stored audio samples. More recently, computer sound cards have been introduced which support "sample loading", enabling sounds to be produced by read-out of pre-loaded audio samples, for example during playing of a computer game.

As an example of a conventional sample-based artificial musical instrument, consider a MIDI music keyboard. When a key on the MIDI keyboard is depressed, a pre-stored audio sample is played back at a pitch corresponding to the depressed key and with a volume corresponding to the velocity of depression of the key. The audio sample could be played back at the desired pitch by appropriate adjustment of the read-out rate of the stored data defining the audio sample. In early keyboards, a single audio sample was used to generate sounds over the full pitch-range of the device. However, nowadays, in order to produce a more realistic sound, a set of several audio samples is generally used to cover the whole range of a MIDI keyboard, with one audio sample being used for a group of adjacent keys on the keyboard.

Sample-based sound-producing devices have been successful because they produce very realistic sounds. Moreover, a single sample-based synthesizer can emulate, very realistically, the sounds of many different musical instruments. Typically, the user operates function buttons or control switches to select a desired musical instrument and then plays the synthesizer to produce sounds as if he were playing the selected musical instrument. As the user plays, the synthesizer selects, from its memory, pre-stored audio samples that correspond to the selected musical instrument and the played keys. The audio samples are usually generated by recording the sounds made by a real musical instrument of the selected type when played in a recording studio under controlled conditions (so as ensure a "pure" sound), or by computer-based synthesis.

In order to set up a conventional playable, sample-based sound-producing device for use, it is generally necessary to generate and record audio samples corresponding to pure monophonic, mono-instrumental musical sounds, manually determine start and end points for looping each sample, and manually assign audio samples to the different triggers that are capable of causing sound to be output by the sound-producing device (e.g. to the different keys of a keyboard). This makes the overall process of preparing the sound-producing device (synthesizer, computer sound card, etc.) for use very lengthy.

As indicated above, synthesizers are not the only devices that play back recorded audio samples. Other devices and systems which play back audio samples include computer games, including console-based games and hand-held devices, etc. In the present document, references to "sound-producing" devices or systems refer to devices or systems which can produce sounds, regardless of whether producing sounds is their main function or an ancillary or optional function thereof.

The present invention relates to sound-producing devices which are "playable". This refers to the fact that sound-production in the device is triggered by operation of some control elements (e.g. keys of a keyboard). However, the triggering of sound production need not be direct triggering by a user operating the control elements, it can include indirect triggering whereby, for example, the user plays a computer game and causes occurrence of some game event (e.g. loss of a life) which triggers production of a designated sound by the computer sound card.

The present invention provides a playable sample-based sound-producing system, as described in the accompanying claims, which generates sounds by playing back audio units which correspond to samples from a source audio track (including samples corresponding to an entire track). The mapping between audio units and triggers of the sound-producing device is based on meta-data descriptive of the respective audio units.

Each of the audio samples (or "audio units") used in the systems of the present invention may correspond to an extract from an audio item (e.g. a particular syllable that is sung, a particular guitar riff, etc. from a song; a particular sound from within an audio file, e.g. the sound of a police siren in a long audio file recording environmental sounds etc.), or it may correspond to the whole of an audio item (e.g. a whole piece of music, whole song, whole soundtrack, whole recording, etc.). The audio samples (or units) need not be of the same length and, indeed, samples of different lengths can be mapped to the same (or different) triggers of the sound-producing device/system.

Meta-data is often associated with music (audio), and is data which describes the attributes of the audio. Typically, meta-data includes data describing "intrinsic" features of the associated audio—for example, pitch, noisiness, tempo, etc.—which can be determined by analysis of the audio itself. Meta-data also often includes data describing "extrinsic" features of the audio, such as the performer, performer's country, year of recording, intellectual property rights owner, etc. The particular meta-data associated with an audio track depends upon the context in which that track is being handled—for example, different music databases may well use different schemas for defining meta-data they will associate with music files.

When triggers in a playable sound-producing system according to the present invention are operated (e.g. notes on a keyboard are played) this results in the production of sounds which correspond to actual sounds present in a source audio file (e.g. a music title) or to playback of the whole of a selected audio file. Consequently, the instrument (or other playable sound-producing device/system) plays the same sounds as in the original audio file. Playing such a sound-producing device/system enhances the player's enjoyment and sense of "ownership" of the experience, because the player can hear sounds from his favourite tunes.

In preferred embodiments of the invention, the selection of audio units to be mapped to triggers on the playable device is made automatically (or a set of selections is made automatically and the particular selection which is used at a particular time depends upon user action as he "plays" the sound-producing device), based on matching a property of the meta-data of the audio units to some property specified in a predefined mapping function. For example, a mapping function may be defined "map samples in minor keys to black notes of a piano-type keyboard", and the system will automatically determine which of the audio samples are in a minor key and map those selected samples to the black keys. Mapping functions can be combined.

In other preferred embodiments of the invention, the user sets the meta-data-based mappings explicitly, for example, using program changes from the MIDI protocol. This can transform a keyboard into a sophisticated and customizable interface (or controller) for accessing an audio collection, for example via a HiFi system, music database, etc. Where a traditional synthesizer would offer the possibility of selecting a piano sound from a predetermined bank of sounds, such embodiments would enable the user to select sounds from his own music collection (e.g. a collection of CDs) such that he could quickly access a large number of songs from his collection simply by pressing an associated key on his keyboard.

The present invention opens up the possibility of creating a whole range of new devices, for example:

- a synthesizer in which the played-back sounds correspond to audio samples derived from the user's favourite music recordings;
- a computer game in which the sound effects correspond to sounds taken from a music track, film soundtrack, or the like, which the user likes;
- a keyboard in which operation of each key causes playback of a different song. With an 88 note keyboard, 88 different songs could be played, one after then other or they could be played polyphonically if the user plays a chord. The set of songs could satisfy some global criterion or criteria, for example, only songs by The Beatles are mapped to the keys of the keyboard;
- a keyboard in which operation of each key causes playback of an audio track in a different category, for example, having different performing artists, instrument, language, country, etc. When a key is pressed a song from the associated category is played back. For each category a set of songs could be stored and, when the associated key is pressed, a song from the set could be selected at random for playback, songs could be selected in turn, songs could be played back in an order dependent on user preferences, etc. The association between keys and categories could hold over a set of keys—for example, on a keyboard emulating a piano, playing a black note could cause playback of a piece of music in a minor key whereas playing a white note causes playback of a piece of music in a major key, etc.;
- interactive devices in which the mapping of audio units to triggers in the sound-producing device can be dynamically modified by user input, including indirect user input—for example, the audio unit played back when a particular trigger is operated may change dependent upon the velocity with which the user hits a key, or dependent upon the melody which the user plays, etc.;

and many more.

The present invention provides a new type of system for automatically generating audio samples ready for playback in a playable sample-based synthesizer or other playable sample-based sound-producing device or system, as described in the accompanying claims.

More particularly, the preferred embodiments of the invention provide an audio-sampler/sample-processor in which units of audio data are extracted automatically from a source of audio data and are assigned automatically to different triggers that are capable of causing sounds to be produced in a sound-producing device or system. Meta-data descriptive of intrinsic characteristics of the audio units is used for automatic determination of a mapping of audio units to the different triggers of the sound-producing device.

Such an audio-sampling/sample-processing system can be configured as a stand-alone device, or it can be integrated with a playable sample-based sound-producing device.

Such an audio-sampling/sample-processing system can use music files of arbitrary complexity—containing polyphonic sounds, containing percussion instruments, containing effects (such as reverberation), etc.—to generate audio samples that are useable by playable sample-based sound-producing devices.

Such an audio-sampling/sample-processing system could be used to automatically produce the monophonic samples used by a conventional sample-based synthesizer, as well as to automatically assign the samples to the keys and automatically determine how each sample should be time-stretched (if required) so as to adjust its duration to the time a user spends pressing down a key. This avoids the lengthy manual configuration that is normally associated with set-up of a conventional synthesizer.

The above and other features and advantages of the present invention will become more apparent from the following description of preferred embodiments thereof, given by way of non-limiting example, and the accompanying drawings, in which:

FIG. 1 shows one preferred embodiment of a playable sample-based sound-producing system according to the present invention. In this example, the sound-producing system is configured as a MIDI-keyboard-type synthesizer 1.

Figure 1:
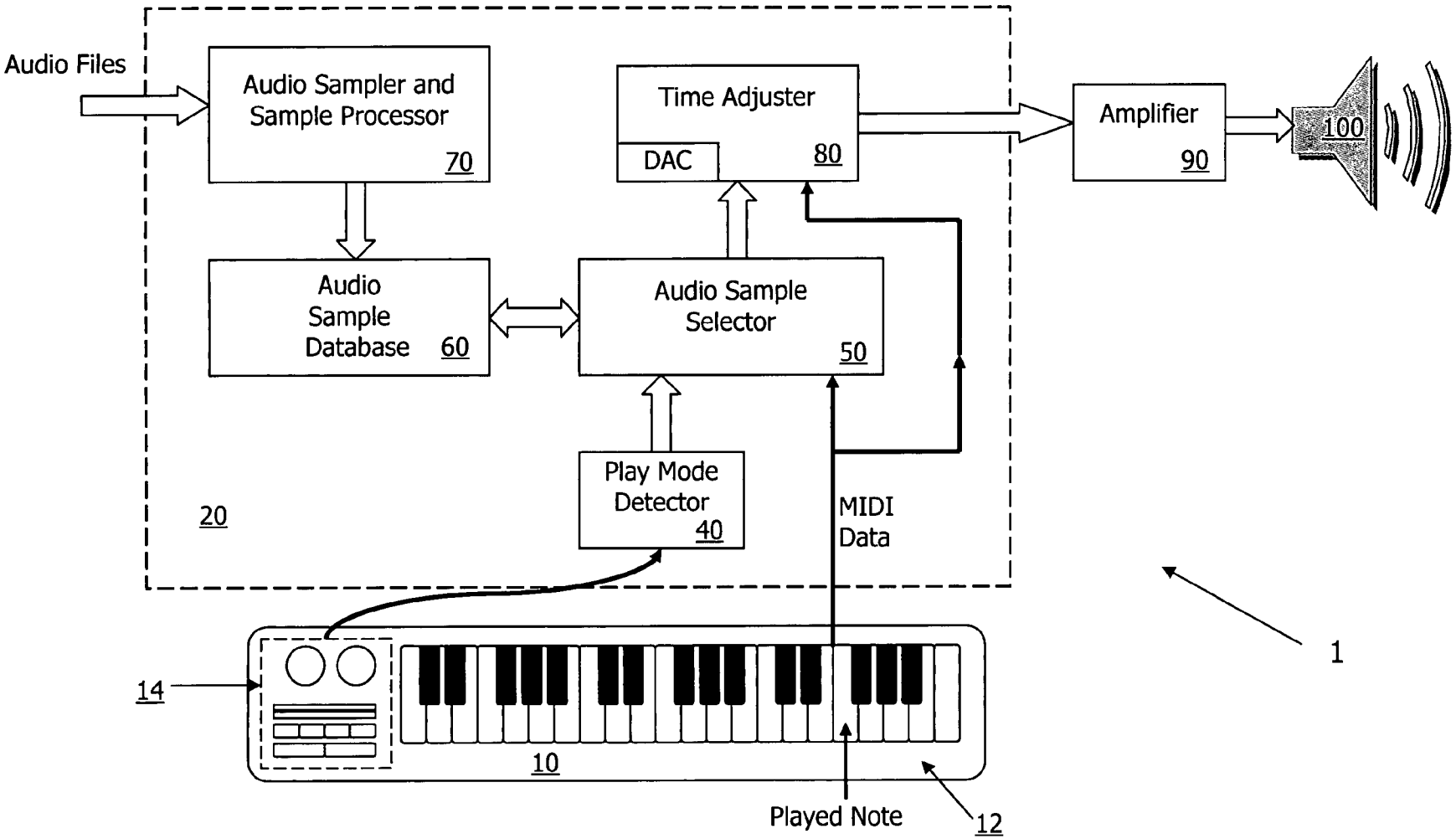
FIG. 1 is a block diagram indicating the main modules in a sample-based sound-producing system according to a preferred embodiment of the invention.

The MIDI-keyboard-type synthesizer 1 includes a keyboard 10 operable by a user, a processing module 20, an amplifier 90 and a loudspeaker 100.

The keyboard 10 has a section that is made up of playable keys 12 which correspond to different musical notes and are arranged similarly to the keys of a piano. The keyboard 10 also includes a number of different dials, sliders and buttons which can be operated by the user so as to set a variety of different parameters (automatic accompaniment, automatic rhythm, play mode, etc.). These dials, sliders, etc. can be considered to form a keyboard control section 14.

When the user presses down a playable key 12 on the keyboard 10, a conventional key-operation detector (not shown) generates MIDI "key-on" event data which is transferred to the processing module 20. The MIDI key-on event data indicates the characteristics of the played key, notably identifying the pitch of the played key (by indicating the "note number" of the played key), as well as the velocity with which the key was depressed. The processing module 20 outputs an appropriate audio signal to the amplifier 90, which amplifies the audio signal and passes it to the loudspeaker 100 so that a corresponding sound can be produced.

The structure and operation of the processing module 20 will now be described in greater detail. It is to be understood that, in practice, the processing module 20 will usually be implemented in software; the different elements shown in FIG. 1 are identified merely to aid understanding of the various functions that are performed by the processing module 20. Moreover, the distribution of functions between the various elements shown in FIG. 1 could be changed and/or these functions could be performed using a lesser or greater number of elements than that shown in FIG. 1.

The processing module 20 includes a play-mode detector 40 which can identify the mode in which the keyboard 10 is being played by the user. Different modes of playing the keyboard will be described in greater detail below. Typically, the play-mode detector 40 will identify the current play-mode from the settings of the dials, sliders etc. in the keyboard control section 14. The play-mode detector 40 passes play-mode data to an audio sample selector 50. The audio sample selector 50 also receives MIDI key-on/-off event data from the keyboard 10.

Based on the pitch data and, optionally, the key-depression velocity and/or play-mode data, the audio sample selector 50 selects an appropriate audio sample for playback. The audio samples are recorded, in digital form, in an audio sample database 60. (An audio-sampler/sample-processor 70 generates the audio samples for the audio sample database 60 from audio files that are input to the sound-producing system 1.) The audio sample selector 50 controls supply of the selected audio sample to a time-adjusting unit 80 which adjusts the duration of the played back audio sample to the length of time that the user holds down the played key 12 on the keyboard 10. The time-adjuster 80 also includes a Digital-to-Analogue Converter (DAC) which converts the signal to analogue form after the time adjustment. The time-adjusted audio sample data, now in analogue form, is supplied to the amplifier 90 and loudspeaker 100 so that an output sound can be produced.

The reason why the time adjuster 80 is required is as follows.

The recorded audio samples will correspond to musical sounds of a particular duration. However, when a user plays a synthesizer he may wish to produce sounds having a duration different from this (often longer, such that it is necessary to "time stretch" the audio sample so that it lasts as long as the user operates the played note). Accordingly, when audio samples are assigned to different musical notes on a synthesizer, it is necessary to specify rules or procedures for coping with potential differences between the duration of the sound in the audio sample and the duration of the note played by a user.

In a similar way, when a computer game produces sounds based on stored audio samples, it may be desired to output sounds for a length of time that is different from the duration of the stored audio sample.

Figures 2, 4:
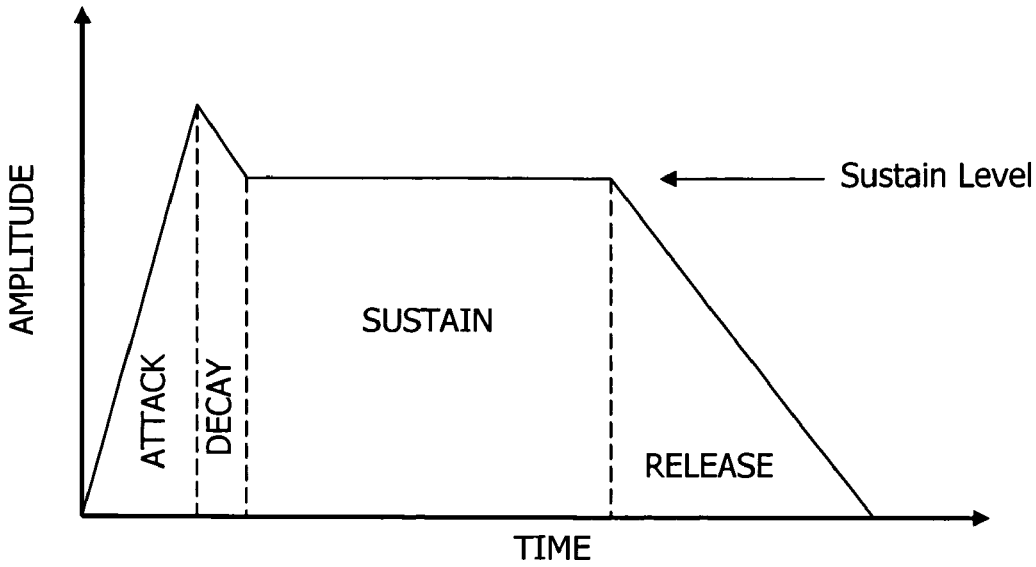
FIG. 2 is a diagram illustrating the general structure of a musical sound.
FIG. 4 is a diagram indicating schematically one example of the structure of data, relating to one audio sample, held in an audio sample database of the sound-producing system of FIG. 1.

Musical sounds can be described in terms of four portions of their amplitude-versus-time envelope: attack, decay, sustain and release (ADSR)—see FIG. 2.

As shown in FIG. 2, attack and decay correspond to transient effects at the beginning of the musical sound, sustain corresponds to the stable part of the sound, and release corresponds to the ending of the note. When the sound begins to be produced, its amplitude rises from zero to a maximum level (this is the "attack" phase and it is generally described in terms of the time taken to reach a certain percentage of the maximum level, typically expressed in milliseconds), then it often reduces slightly (this is the "decay" phase which, once again, is typically described in terms of its duration) and remains at that reduced level for some time (the "sustain" phase, which is generally characterized in terms of the amplitude of this "reduced level", usually expressed in decibels) before reducing to zero once again (the "release" phase, usually described in terms of its duration). For a given musical instrument, the duration of the "attack" phase is often substantially unchanged regardless of the duration of the note. The "decay" phase is not relevant for all musical sounds: for example, it may not be discernable in single notes produced by pipe organs Known sample-based sound-emitting devices generally cope with the difference between the duration of the sound in the audio sample and the duration of the sound to be output as follows:

- when the sound to be output is shorter than the recorded audio sample:
  - the recorded audio sample is played back from the beginning thereof (attack and, if relevant, decay portions), continuing on to the sustain portion, but as soon as the user releases the played note (or it is determined that the output sound should be discontinued) playback skips to the release portion of the audio sample.
- when the played note is longer than the recorded audio sample:
  - the recorded audio sample is played back from the beginning thereof (attack and, if relevant, decay portions), continuing on to the sustain portion, then the sustain portion is looped until the user ceases to hold down the key or button on the synthesizer (or it is otherwise determined that the output sound should be discontinued). When the user stops holding down the played key, either the playback skips directly to the release portion, or the looping of the sustain portion is continued for a short while with the amplitude gradually decreasing to zero.

In order to be able to loop the sustain portion of the recorded audio sample, the sound-emitting device (e.g. synthesizer) needs to have defined for it the points within the audio sample at which it should start and end the loop (repeated portion). If the loop-start and loop-end points are chosen badly then there will be undesirable sounds such as repetitive clicks or pops, or else the tone will be perceived as "thin" (if the loop is too tight). Usually the loop-start and loop-end locations within the audio sample are found manually by a lengthy process of trial and error (depending upon the waveform, it can be extremely difficult to find appropriate locations). However, aside from taking up time, the process for looping the sustain portion of an audio sample is relatively straightforward if the audio sample is a "pure" monophonic, mono-instrumental sample (without effects such as "reverberation" which often occur when sounds are recorded in a natural setting).

During use of preferred embodiments of the present invention, the audio samples requiring looping may be polyphonic samples, and they may have been recorded in a naturalistic environment (producing effects such as reverberation). Accordingly, the time adjuster 80 employed in preferred embodiments of the present invention is different from those used in conventional synthesizers. This is explained in greater detail below.

However, at this stage it is useful to consider the structure and function of the audio-sampler/sample-processor 70 that generates the audio sample data for the database 60. The audio-sampler/sample-processor 70 will be described below with reference to the block diagram of FIG. 3. Once again, it is to be understood that, in practice, the audio-sampler/sample-processor 70 will usually be implemented in software; the different blocks shown in FIG. 3 are identified merely to aid understanding of the functioning of the audio-sampler/sample-processor and the same functions could be distributed differently and/or performed using a lesser or greater number of elements than that shown.

It should be noted that it is not essential for the audio-sampler/sample-processor 70 to be formed as an integral part of the sound-producing system 1, it could be separate. Moreover, in various preferred embodiments of the invention in which the audio samples correspond to whole songs (or the like) the audio sampler/sample-processor may be omitted (the audio samples would be stored in association with their meta-data and the function for mapping samples to triggers of the playable sound-producing device would be defined manually).

Figure 3:
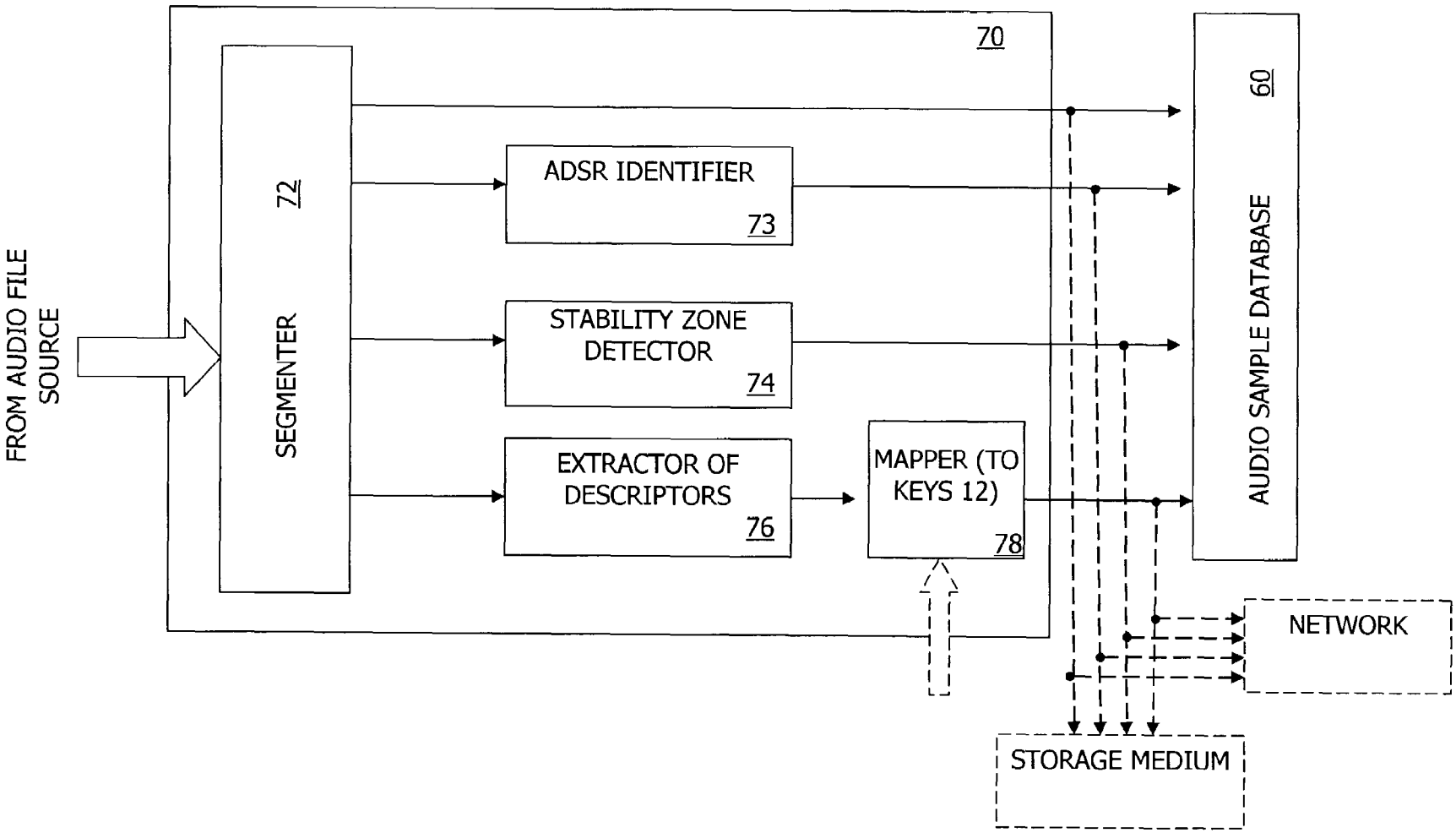
FIG. 3 is a block diagram indicating the main modules in a sound-sampling and processing system used in FIG. 1.

As indicated in FIG. 3, the audio-sampler/sample-processor 70 receives audio files from some source. This source could be a storage medium (for example, an audio CD, the hard disc of a computer, etc.), a network connection (to a LAN, a WAN, the worldwide web, etc.), or even a sound-capture device (such as a microphone and A/D converter). The audio file source could be distant from the audio-sampler/sample-processor 70, but it could equally well be local to the audio-sampler/sample-processor 70 or integrated with it into a single overall device.

An audio file input to the audio-sampler/sample-processor is supplied to a segmenter 72 which analyzes the sound file so as to detect and isolate meaningful events that could be considered as individual samples. Data defining each extracted sample is supplied to the audio sample database 60. The automatic segmentation process will be described in greater detail below. For the time being, suffice it to mention that samples can overlap.

Each sample is supplied to an ADSR identifier 73, which automatically identifies the respective attack-decay-sustain-release portions of the waveform and supplies the audio sample database 60 with data defining the locations of these portions.

Each sample is also supplied to a detector 74, which automatically detects zones of spectral stability within the sample and determines the degree of spectral stability of these stable zones. This stability data will be used during playback of the audio sample when it is necessary to perform time-stretching (see below). Data identifying the zones of stability within a sample, and the degree of stability of each such stable zone, is supplied to the audio sample database 60 and is stored therein in association with data identifying the audio sample to which this stability data relates.

Each sample is also supplied to a module 76 for automatically extracting high level descriptors of the properties of the sound represented by the audio sample. These audio descriptors can be associated with the audio sample (as meta-data), and used later on to select, automatically, the most appropriate samples to use for a given context. The audio descriptors can include data describing one or more attributes, for example: pitch, energy, "noisiness", percussivity, timbre, harmonicity, etc. Descriptor data for each extracted audio sample is stored in audio sample database 60. Furthermore, the descriptor data is also used by a mapping module 78.

The mapping module 78 may decide based on examination of the meta-data generated for a given audio sample that this sample is uninteresting and should be discarded. This could be the case where, for example, a sample corresponds to audience noise at the end of a song—study of meta-data indicating the sample's harmonicity would enable a determination to be made that the sample corresponds to this kind of noise, leading to the sample being discarded (i.e. not mapped to any key of the keyboard).

The mapping module 78 automatically assigns audio samples to the different playable keys 12 of the MIDI keyboard (the "output domain"). In other words, the mapping module 78 determines which audio sample(s) may be played back when the user presses each of the playable keys 12 of the keyboard 10.

In general, the mapping module 78 will select which audio samples map to different playable keys 12 of the MIDI keyboard based on a predefined mapping function; the mapping function specifies a condition, holding on meta-data, for mapping audio samples to particular playable keys and, by examining the meta-data of the audio samples, the mapping module 78 determines automatically which audio samples satisfy the specified condition.

For example, the mapping module 78 may have a predefined mapping function "assign audio samples having (pitch=i) to a playable key assigned to (pitch=i)", or "assign audio samples having (tonality=minor key) to black keys on a piano-type keyboard", or "assign all samples having (pitch=j) and (timbre=piano) to playable key having (pitch=j)", etc. The mapping module automatically determines which audio samples satisfy these conditions and map them to the specified keys.

The mapping module 78 assigns extracted audio samples to the "playable" domain of a sample-based sound-producing device or system. In the present example, the playback device is the MIDI-keyboard-type synthesizer 1 and the "playable domain" of the device consists of the set of playable keys 12 of the keyboard 10. The correspondence between the keys on a conventional piano and the pitches of musical notes is well-known, so the mapping module 78 does not need to be informed explicitly about the nature of the elements in the domain to which it is assigning samples—although it is preferable for the mapping module to know the range of the sound-producing device that will be used for playback (e.g. how many octaves, beginning at which musical note).

By way of contrast, if the playback device is a computer game, the "playable" domain consists of the different sounds that may be produced during the game and these will generally not correspond to a pre-determined scale of pitches.

For example, in a so-called "shoot 'em up" game, the computer game might recognize four distinct sounds labelled Sound A, Sound B, Sound C and Sound D, Sound A being emitted in certain circumstances during the game (e.g. "when a bomb explodes", and "when a rocket is launched"), Sound B being emitted in other specified circumstances (e.g. "when a tank manoeuvres"), Sound C being emitted in yet other circumstances (e.g. "when a player loses a life" and "when the game is over"), whereas Sound D is emitted in yet further circumstances (e.g. "when the player gains an extra life" or "when the player acquires an additional weapon"). In such a case, the mapping module 78 would assign extracted audio samples to each of the Sounds A to D (which represent the "playable" domain of the computer game).

In a case of this type, the mapping module 78 should be provided with information identifying at least the number of different sounds that are selectable in the sound-producing device and, possibly, some information describing characteristics of these sounds (e.g. "Sound A should be percussive and of lower pitch than Sound B"). This information can be provided by pre-programming of the mapping module 78 (if the audio-sampler/sample-processor 70 is integrated into a system used for playing the computer game), or via a suitable input or interface (represented in FIG. 3 by the dashed arrow).

Returning to the present embodiment, the mapping module 78 may assign a particular extracted audio sample to one or to several of the playable keys 12 of the keyboard 10. For example, the mapping module 78 may determine that a given audio sample $AS_1$ has the sound C (basing this determination on the meta-data that has been generated for sample $AS_1$ by the extractor 76) and may then assign this extracted sample $AS_1$ to a particular C key on the keyboard 10 (e.g. the C4 key) as well as to neighbouring notes (B4 and D4). When the user presses the D4 key, it is necessary to transpose the pitch of the assigned audio sample so that it can be played back at the pitch appropriate to the key being pressed by the user. As is well-known, this pitch transposition can be accomplished by changing the playback rate of the audio sample.

Incidentally, there are many cases where the samples extracted from an audio file may not include all of the notes in the "playable domain" of the keyboard. For example, samples extracted from the song "Yesterday" are unlikely to include the note F# because the song itself is in the key of F. Thus, in view of the fact that the keyboard 10 includes the note F# (and other notes which are not in the key of F), it is likely to be necessary to transpose the pitch of audio samples extracted from "Yesterday" if the user is to have the possibility of freely playing any musical note he desires on the keyboard 10.

It is also possible for the mapping module 78 to assign more than one audio sample to a given playable key (or, more generally, to a given element of the "playable domain"). This could occur when more than one of the extracted samples corresponds to the same musical note, or to notes closely-grouped around one musical note, (e.g. B♭), but these samples have different properties (e.g. different levels of percussivity or energy, correspond to different sung phonemes, etc.). In such a case, at the time of playback a choice can be made as to which one of the assigned samples should be played back when the associated playable key is pressed. The criteria on which this choice is based are discussed in greater detail below. For the time being it is sufficient to mention that these criteria can be set in different ways: the audio-sampler/sample-processor 70 may set the criteria governing the choice between different audio samples assigned to the same sound of the sound-producing device (e.g. by storing selection rules in the audio database 60); or these criteria may be set by the sound-producing device, for example, in this embodiment, they may be programmed into the audio sample selector 50, or they may depend upon settings of function switches/controls provided on the sound-producing device (notably, in the keyboard control section 14).

The assignment of audio samples to different keys of the operable section 12 of the keyboard 10 is also recorded in the audio sample database 60.

When the audio-sampler/sample-processor 70 has processed an audio file, the audio sample database 60 will contain data defining and describing each audio sample that has been extracted from that file and assigned to a playable key of the keyboard 10, as well as data defining the mapping of samples to the playable keys 12 of the keyboard. FIG. 4 shows one example of the structure of the data that may be held in the audio sample database for one audio sample. In the example illustrated in FIG. 4, the data defining the mapping of samples to playable keys forms part of the data associated with each sample, rather than being grouped into a separate block of data dedicated to mapping information.

In the example illustrated in FIG. 4, the data held in audio sample database 60 for one audio sample includes the following.

- the sample number (enabling this audio sample to be identified and distinguished from the others);
- the audio sample data itself (that is, the digitized waveform represented using n bytes of data);
- ADSR data comprising:
  - DSB, that is, data identifying which byte of the audio sample data corresponds to the beginning of the Decay portion of the sound,
  - SSB, that is, data identifying which byte corresponds to the beginning of the Sustain portion of the sound, and
  - RSB, that is, data identifying which byte corresponds to the beginning of the Release portion;
- Stability Data, comprising:
  - SZ1_SB, that is, data indicating which byte of the audio data corresponds to the beginning of the first zone (SZ1) of spectral stability in this sample,
  - SZ1_EB, that is, data indicating which byte of the audio data corresponds to the end of SZ1,
  - SZ1_ST, that is, the level of stability of SZ1,
  - SZ2_SB, SZ2_EB, SZ2_ST, etc. until stability data has been provided for all m zones of spectral stability in this sample (m=1, 2, . . . )—even if the sample has no zones which are particularly stable, at least one zone, the most stable there is, will be identified and used to produce stability data;
- Audio Descriptors, including data indicating the pitch (or note number), energy, noisiness, percussivity and timbre of the sample;
- Key assignment, that is, an indication of the playable key (or keys) 12 of the keyboard 10 to which this audio sample is assigned.

The user of the MIDI-keyboard-type synthesizer 1 may decide that he would like to play his synthesizer so as to produce sounds contained in the Beatles' song "Yesterday", as in the original recording of the Beatles' album "Help". The user may know that this audio file has already been processed by the audio-sampler/sample-processor 70 so that samples derived therefrom are already present in the audio sample database 60, or he may know that this audio file is accessible to the audio-sampler/sample-processor 70. An appropriate user interface (not shown) may be included in the MIDI-keyboard-type synthesizer 1 so as to enable the user to see a list of already-processed or accessible audio files and to select the audio file of his choice. Operation of the user interface can trigger supply of the selected audio file to the audio-sampler/sample-processor 70.

Figure 5:
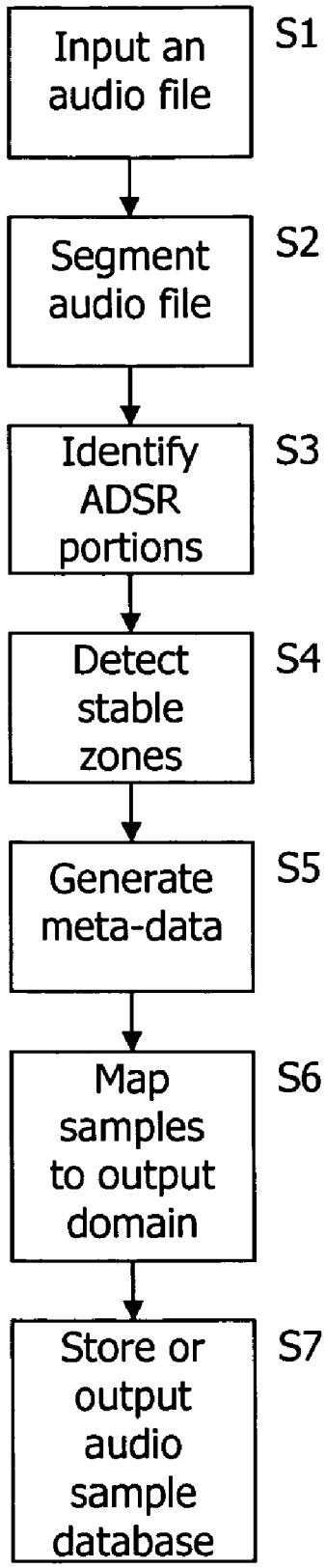
FIG. 5 is a flow diagram indicating the main functions performed by the sound sampling and processing system of FIG. 3.

The flow diagram of FIG. 5 illustrates the steps that occur as the audio-sampler/sample-processor 70 processes an audio file, beginning with receipt of the selected audio file in Step S1 of FIG. 5.

When the audio file is supplied to the audio-sampler/sample-processor 70, the segmenter 72 automatically extracts from the recorded music a number of audio samples which correspond to meaningful events—see Step S2 of FIG. 5. The aim of the segmentation algorithm is to extract samples that can act as well-defined musical events, that is, which have a salient note or percussion played by some instrument(s) in the foreground, and a background based on the global sound of the sampled piece of music. Typically, an event is an instrument note or a percussion sound. An example of a sample would be Paul McCartney singing " . . . day . . . " in the song "Yesterday", with the song's original background of acoustic guitar, bass and violin. Extraction of these samples involves cutting the piece of music in the time domain. Each sample contains several instruments playing at the same time, not separated into individual tracks.

The above-described automatic segmentation of a piece of music or other sound sequence (represented by an audio file) can be achieved by analyzing the energy variations of the short-term spectrum of the music's waveform (obtained via windowing and computation of the Fourier transform), more particularly, by examining the maxima and minima of the waveform. Typically, the sample start point is defined at a position where there is a rapid change from a local minimum to a local maximum of the short-term spectrum and the sample end point is defined at a position where there is a rapid change from a local maximum to a local minimum of the short-term spectrum.

Before the energy variations in the waveform are analyzed, it is advantageous for the spectrum of the piece of music (or other sound sequence) to be transformed by a filter bank which mimics the frequency resolution and frequency response of the human ear. For example, the human ear is not very sensitive to frequencies higher than 15 kHz. By performing this filtering, the frequency spectrum of the waveform becomes perceptually-weighted.

Figure 6:
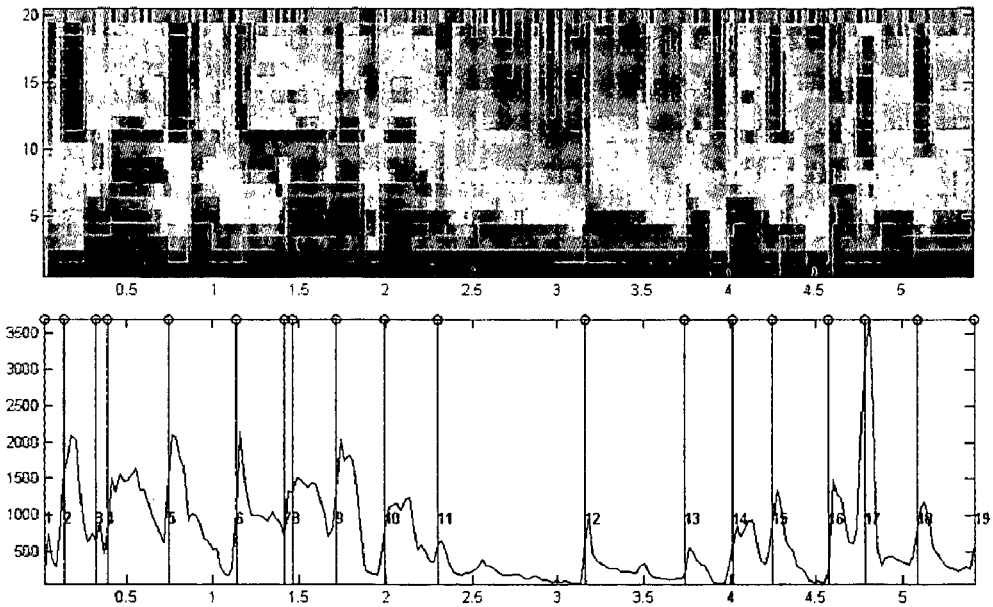
FIG. 6 is a diagram illustrating automatic segmentation of a song into samples by the sound sampling and processing system of FIG. 3.

FIG. 6 illustrates one example of segmentation of a song into 19 samples. The upper part of FIG. 6 shows a spectrogram of the song, whereas the lower part of FIG. 6 shows the energy of the perceptually-weighted spectrogram and indicates how the 19 samples can be defined.

Once the segmenter 72 has identified samples in the piece of music (or sound sequence) represented by the audio file, the properties of the samples can be analyzed. One element of this analysis consists in identifying the attack-decay-sustain-release portions of the sample, typically by analyzing the energy profile of the sample, using the ADSR identifier 73: for example, the attack time can be determined to be the time taken for the sample's energy to grow to 80% of the maximum value in the sample. Another element of the analysis consists in detecting zones of spectral stability in the sample (step S4 of FIG. 5).

Many samples resulting from the segmentation technique used by the segmenter 72 are not ideally stable (in terms of their frequency): although each sample is a coherent note (e.g. the tone held during the syllable " . . . day . . . " mentioned above), there can still be minor events occurring in the background (e.g. softer notes of the guitar accompaniment). When samples are generated by sampling arbitrary recordings there will be complex polyphony, background percussion and effects (such as reverberation) due to "real-world" sound production and these can create discontinuities of timbre, energy, etc. if the "sustain" portion of the samples were to be looped during playback. In order to avoid problems of this kind during time-stretching of audio samples extracted from an audio file, the preferred embodiments of the invention identify stable zones within the audio sample and apply time-stretching preferentially to these stable zones.

As shown in FIG. 3, the audio-sampler/sample-processor 70 includes a stability-zone detector 74. This detector 74 can use different techniques to identify zones of spectral stability within an audio sample. For example, the detector 74 may evaluate the variation over time of factors such as the spectral centroid (centre of gravity of the spectrum), spectral flatness ("noisiness of the signal"), spectral rolloff (frequency range of the signal), in order to identify regions within the sample where the spectrum is relatively stable. This evaluation may involve study of a single factor or, preferably, may involve consideration of a plurality of factors (with suitable weighting). When a stable zone has been identified, the detector 74 generates a stability score indicative of the level of spectral stability of this zone. In general, the stability score will be based on the value(s) of variation of the factor(s) taken into account when detecting the stable zones. Data identifying the stable zones and their degree of stability is stored in the audio sample database 60 for the audio sample in question. This stability data can be used by the time adjuster 80 of the sound-producing device during time-stretching of this audio sample, as described below with reference to FIG. 8.

The audio samples identified by the segmenter 72 are also analyzed by the extractor 76 which automatically determines high-level attributes relating to the audio properties of each sample. This descriptor data is associated, as meta-data, with the audio sample data in the audio sample database 60—see Step S5 of FIG. 5. Preferred techniques for determining values for various high-level audio descriptors are, as follows:

Energy of the sample: determined, for instance, by measuring the amplitude of the "sustain" part of the sample waveform's envelope.

"Noisiness": determined, for instance, by evaluating spectral flatness (that is, the ratio between the geometrical mean and the arithmetical mean of the spectrum's amplitude)—the flatter the spectrum the noisier the sound.

"Percussivity": quantified by measuring the energy of the "attack" portion of the sample envelope.

Timbre: modelled by its Mel Frequency Cepstrum Coefficients.*

Pitch: found by analysis of the "sustain" portion of the sample envelope.

*The Mel Frequency Cepstrum Coefficient is a standard characterization of a signal and is the inverse Fourier transform of the log of the spectrum.

$$c_n = \frac{1}{2n} \times \int_{\omega=-\pi}^{\omega=+\pi} \log(S(e^{j\omega})) \cdot e^{j\omega n} d\omega$$

The expression "mel-cepstrum" is used for the cepstrum computed after a non-linear frequency warping onto the Mel frequency scale. The $c_n$ are called MFC coefficients (MFCC). MFCCs are widely used for speech recognition but can provide a way to measure the similarity of timbre between two songs. By comparing the MFCCs of two songs it can be estimated whether or not these two songs sound the same.

According to the preferred embodiment of the invention, the pitch of each sample is determined using a new approach adapted to cope with the fact that each sample is likely to relate to a complex polyphonic sound.

Traditional algorithms for determining the pitch of an audio sample are based on detecting peaks in the spectrum of the sound waveform. These algorithms have a low rate of success because of the peak-picking heuristics, and due to factors such as vibrato and polyphony which increase signal complexity.

Figure 11:
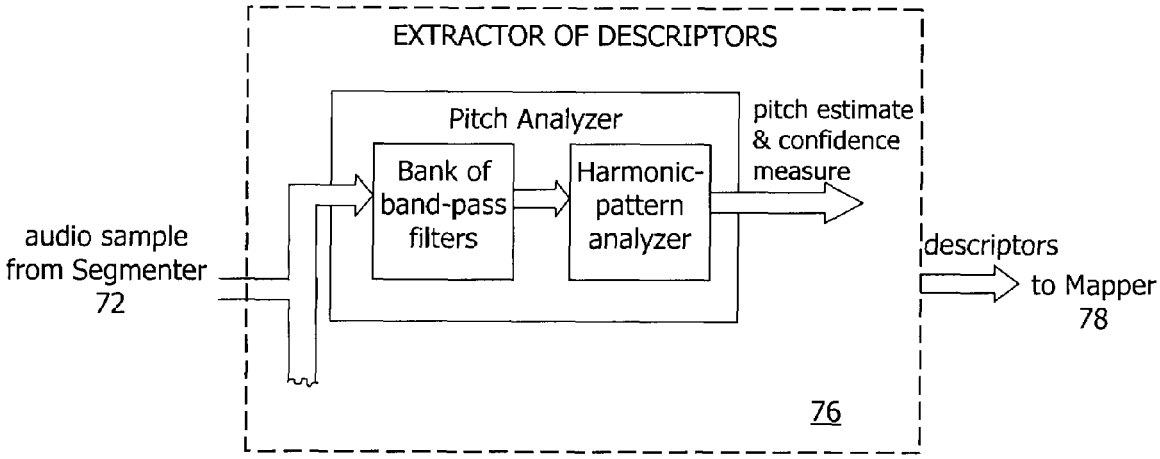
FIG. 11 is a diagram illustrating the Pitch Analyzer containing a bank of band-pass filters and Harmonic-pattern analyzer located in the Extractor of Descriptors.
Figure 9:
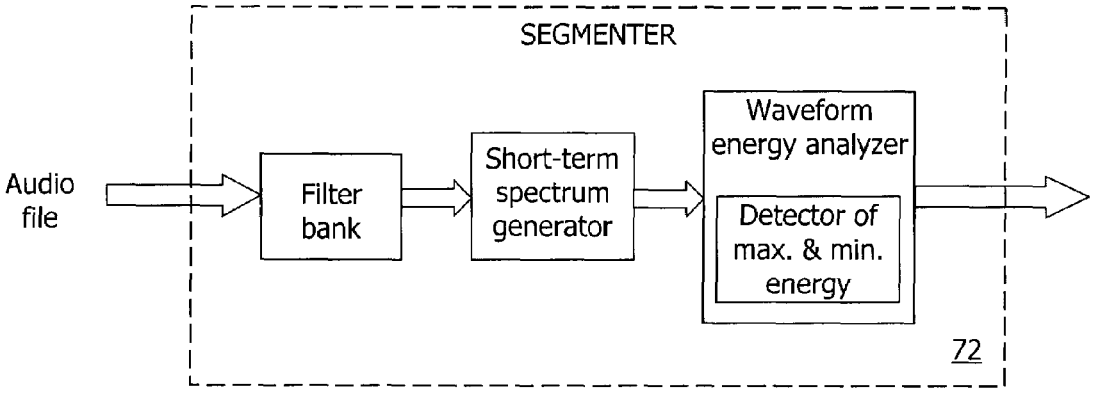
FIG. 9 is a diagram illustrating the filter bank, short-term spectrum generator, and waveform energy analyzer in the Segmenter.

By way of contrast, according to the preferred embodiment of the invention, pitch is determined, as follows:

As shown in FIG. 9 and FIG. 11 the first the sound waveform is supplied to a MIDI pitch filter bank, acting as a converter from a frequency representation to a pitch representation. This filter bank is a bank of bandpass filters, one per MIDI pitch, from midi pitch 0 to 127 (i.e. CO to G10), each with the width of one semitone. The waveform emerging from this filter bank is a much cleaner symbolic signal which represents the weight of each potential note in the signal.

The symbolic signal is composed of the different weights of the pitches present in the sample. A single note, say C4, will also produce non-negligible contributions for pitches at harmonic positions for C4, namely one octave above (C5), octave+fifth above (G5), etc. The symbolic signal is analyzed to find such harmonic patterns, for example octaves and fifths, and to identify the pitch of the individual note (where the sample corresponds to a single note) or the pitches of the chord (if the sample corresponds to a chord).

A value is also generated for a confidence measure indicating a level of confidence in the pitch estimate, by combining the weight of pitch of the note and the weights of its harmonics. For samples that do not have a prominent pitch, this confidence measure can be used to evaluate the noisiness of samples (by comparing the value of the confidence measure with a threshold value). Although noisiness can be estimated by considering spectral flatness, a signal which has a "flat" spectrum has few peaks in its spectrum and will generate low weights in the pitch analysis procedure and, thus, give rise to a low value of the confidence measure.

The descriptors extracted by the descriptor-extractor 73 are preferably used by the mapping module 78 when it decides how to map audio samples to the playable keys 12 of the keyboard 10—step S6 of FIG. 5. In particular, the mapping module 78 takes into account the pitch of each audio sample, obtaining the pitch information from the meta-data (descriptors) associated with the sample. For example, an audio sample of a note Eflat4 can be assigned to the Eflat4 key of the keyboard 10, as well as to its neighbours (pitch transposition will be used when playing back the Eflat sample for these neighbours).

As indicated above, the sample-based sound-producing system 1 is not obliged to use a single, fixed mapping of audio samples to playable keys. On the contrary, the assignment of audio samples to playable keys can be varied in a number of different ways.

For example, the mapping module 78 may assign a set of audio samples to the same playback key. It may then specify the conditions under which each particular sample will be chosen for playback. This can be achieved in many different ways. For example, the mapping module 78 can develop different mappings of audio samples to playback keys: for example, it might define a first mapping to be used if the user is playing the keyboard in a first play mode, a second mapping to be used for a second play mode, etc. Alternatively, at the time of playback, the set of samples assigned to the played key may be identified, then the meta-data associated with these samples examined so as to match a characteristic of the user's performance to a property of the sound in the audio sample—for example, an attempt may be made to match a MIDI parameter such as velocity, which is related to the user's performance, to a sample-descriptor such as percussivity or energy, a high MIDI velocity leading to selection of an audio sample with relatively greater energy or percussivity.

In certain embodiments of the invention, a set of samples may be assigned to a single trigger of a playable sound-producing device and the system may select which sample from the set to play when the trigger is operated by choosing at random within the set or by choosing each sample of the set in turn. One of the features which makes playing of a device according to the invention pleasurable for the user is the feeling of recognition which comes with triggering playback of a sound from a familiar audio file. Thus, it is preferable to keep many instances of samples having the same pitch from a given audio file (which will tend to be mapped to the same triggers but may correspond, for example, to different sung phonemes which the user can recognize) and play them all back at various times.

The overall system 1 may be configured such that the mapping module 78 defines different mappings of audio samples to playable keys and changes from one mapping to another are made using MIDI program changes.

It is not essential for the mapping module 78 to assign audio samples to all of the playable keys 12 of the keyboard 10. In some circumstances it may be preferred to leave some of the playable keys to serve as function keys, or as keys of a conventional synthesizer. In this case, it can be considered that the "playable domain" of the keyboard 10 excludes the playable keys which are serving as function keys or keys of a conventional synthesizer.

The mapping or mappings developed by the mapping module 78 are recorded in the audio sample database 60, either as part of the data associated with each sample (as in the example of FIG. 4—"key assignment" field), or in a separate block of data dedicated to mapping data.

It should be noted that the extracted audio sample data, stability data, descriptors, mapping data, etc. could be recorded in a memory that is internal to the audio-sampler/sample-processor 70 instead of (or as well as) being be output from the audio-sampler/sample-processor 70 (step S7 of FIG. 5). Furthermore, this audio data, etc. can be output directly to a memory of the sound-producing device (as shown in FIG. 1), or it could be output from the audio-sampler/sample-processor 70 to some intermediate storage medium (CD-ROM,hard disc, remote network device, etc.) which is accessible to the sound-producing device. In other words, it is not essential for the audio sample database 60 to be internal to the sample-based sound-producing device 1, as long as that sound-producing device 1 can access the sample data in the audio sample database 60.

Figure 7:
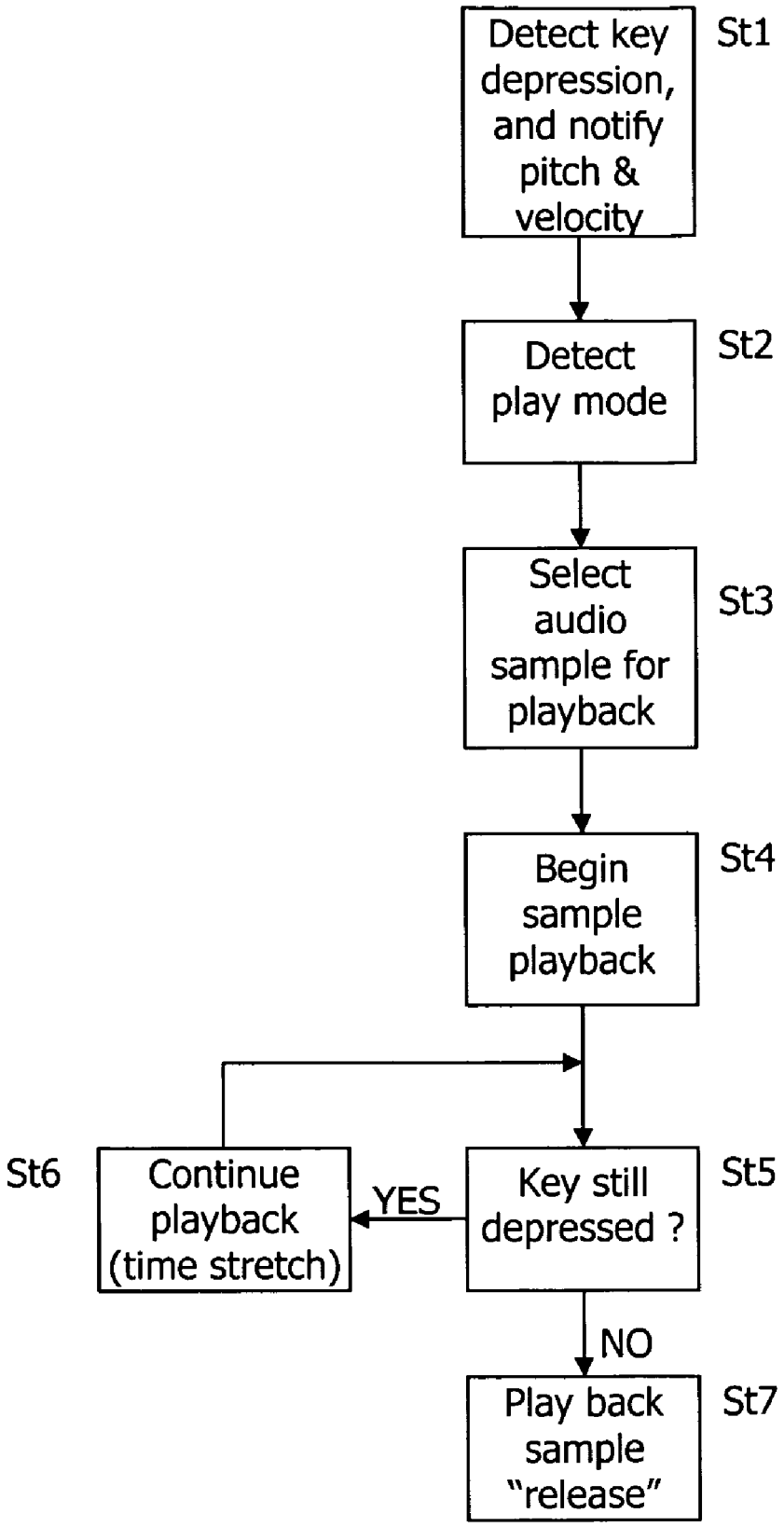
FIG. 7 is a flow diagram indicating the main functions performed by the sample-based sound-producing system of FIG. 1 when a playable key is pressed by a user.

It is helpful to consider what happens when a user plays the keyboard 10. FIG. 7 is a flow diagram indicating the main operations that are performed when the user presses one of the playable keys 12.

As mentioned above, depression of a playable key on the keyboard 10 is detected by conventional key-depression detection means (step St1 of FIG. 7). The pitch and velocity of the played note are notified to the audio sample selector 50. The play-mode detector 40 also determines what are the settings of the different elements in the keyboard control section 14 in order to detect the current play mode of the keyboard (step St2). Play-mode data is also supplied to the audio sample selector 50.

The audio sample selector 50 selects an audio sample from the audio sample database 50 for playback (step St3). First of all, the audio sample selector 50 consults the audio sample database 60 to determine which audio sample has (or audio samples have) been assigned to the playable key which has been pressed on the keyboard 10. More particularly, the audio sample selector 50 searches the database 60 for the sample or samples that have been assigned to the pressed key, the "pressed key" being identified by the pitch (or note number) thereof.

As mentioned above, there may be more than one audio sample in the database 60 that is assigned to a given playable key on the keyboard 10. In such a case, the audio sample selector 50 selects one of the assigned audio samples for playback, basing its selection on one or more of a variety of factors. According to the preferred embodiment of the invention, the choice is made by comparing the properties of each of the assigned audio samples (as described in their descriptors) with the characteristics of the user's playing of the pressed key and/or the play mode. For example, at the time of playback, if the user has pressed a playable key of the keyboard 10 very vigorously (determined from the velocity of key-depression), it may be more appropriate to play back an audio sample having a greater energy level, or greater percussivity.

As indicated above, the keyboard 1 can be used in different play-modes. Certain play-modes are interesting because they select audio samples for output according to their original context in the original audio file, e.g. their position within the audio file (fourth sample, twentieth sample, etc.). This context is indicated by the meta-data associated with the audio sample. For instance, notes triggered from the user's operation of playable keys can, when he plays the next key, automatically be followed by playback of a sample representing a close event in the original music stream (assuming that there is more than one sample that could be chosen for playback when this "next key" is pressed). As a consequence, an interaction between the player and the recorded/sampled music can originate. Different modes of interaction can be explored:

- imitation (playing with exactly the same sound/style/timeline as the sampled music);
- opposition (playing with a different sound from that of the sampled music);
- turn-taking (alternating the original music and the player's own), etc.

Some playing modes may modify, automatically, the mapping of samples to keys during the interaction. There are many interesting possibilities in regard to such mappings which are set interactively, i.e. which are dynamically modified by user input:

- The user may press a key that causes playback of a song having particular meta-data—for example a song of a particular genre, say a rock song, or a song by a particular performer, say The Rolling Stones—and the system may map, automatically, songs having the same meta-data (same genre/performer) onto the same zone of the keyboard.
- In a mode where the user can play a melody (whether by playing back audio extracts derived from audio source files, s in preferred embodiments of the invention, or using the keyboard as a conventional synthesizer) the system can create a new mapping of audio samples to keys, based on characteristics of the user's performance. For example, if a user plays a melody in C minor (which can be determined automatically), the system may map audio samples in the same C minor tonality to the keys of the keyboard so that the background polyphony in the audio samples is in harmony with the melody the user is playing—i.e. the mapping of audio samples to triggers (here keys on the keyboard) depends on the tonality of the user's performance—or select a song in the same tonality for playback (such that the user can stop playing and listen to it). As another example, consider the case where the user plays the song "Michelle" by The Beatles using keys mapped to sounds from The Beatles' song "Yesterday". The system may automatically change over to a mapping in which audio samples derived from "Michelle" are mapped to the keys of the keyboard—i.e. the mapping from audio samples to triggers (here, keys of the keyboard) depends on the tune played by the user. These dependencies (of the mappings from audio samples to triggers) based on user performance may be additional to another dependency based on the meta-data of the audio samples.
- Consider the case where the user plays a note with a greater or lesser velocity, this could cause playback of a different audio extract (or entire song) dependent upon the velocity with which the key was struck.

Fully interactive musical instruments of these types allow the user to compose music on the fly using sounds from his favourite tunes. This represents a convergence between passive listening (e.g. to a HiFi) and active performance (e.g. on a musical instrument).

When the audio sample selector 50 has selected the appropriate audio sample, payback of the selected audio sample is started (step St4), beginning with the first bytes of audio data (which correspond to the attack portion of the sound, the delay portion (if appropriate), and the beginning of the sustain portion). The audio data is supplied to the time adjuster module 80 and fed on to the amplifier 92 and loudspeaker 100.

Figure 10:
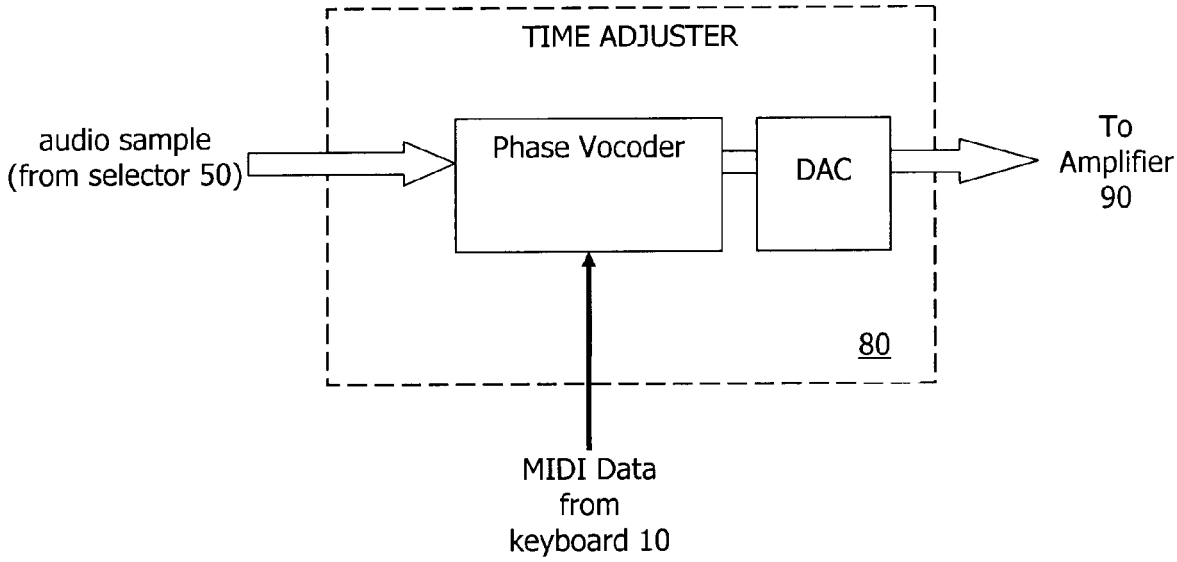
FIG. 10 is a diagram illustrating the time adjuster.

As shown in FIG. 10 the time adjuster 80 controls playback of the audio data so as to match the duration of the output sound to the length of time the user holds down the played key and also converts the audio data from a digital to an analogue form (so as to be able to drive the loudspeaker 100). The time adjuster 80 monitors whether or not the played key is still pressed down (step St 5). If it is determined that the user has stopped pressing down the played key, the time adjuster 80 skips to those bytes of audio data which correspond to the "release" portion of the sound in the selected audio sample (step St 7). On the other hand, if the time adjuster 80 determines that the played key is still pressed down, time stretching of the selected audio sample maybe required. For example, if the selected audio sample corresponds to Paul McCartney singing the syllable"... day ...", as in the example mentioned above, this sample lasts only 1.44 seconds. Time stretching will be required if the user holds down the played key for more than 1.44 seconds.

As mentioned above, it is not appropriate to apply conventional time-stretching techniques to audio samples which correspond to complex polyphonic sounds. The preferred embodiment of the invention uses a new approach so as to avoid unwanted effects (for example transient smearing, such as guitar attacks which last too long). In particular, the time adjuster 80 stretches only those parts of the audio sample that have been identified as stable zones, that is, zones of spectral stability. The stability data (produced by the detector 74 of the audio-sampler/sample-processor 70) stored in the audio sample database 60 informs the time adjuster 80 as to which zones of the selected audio sample are stable zones, and what is their degree of stability. The time adjuster then stretches only the stable zones of the audio sample, applying a stretching factor that is proportional to the zone's stability.

Figure 8:
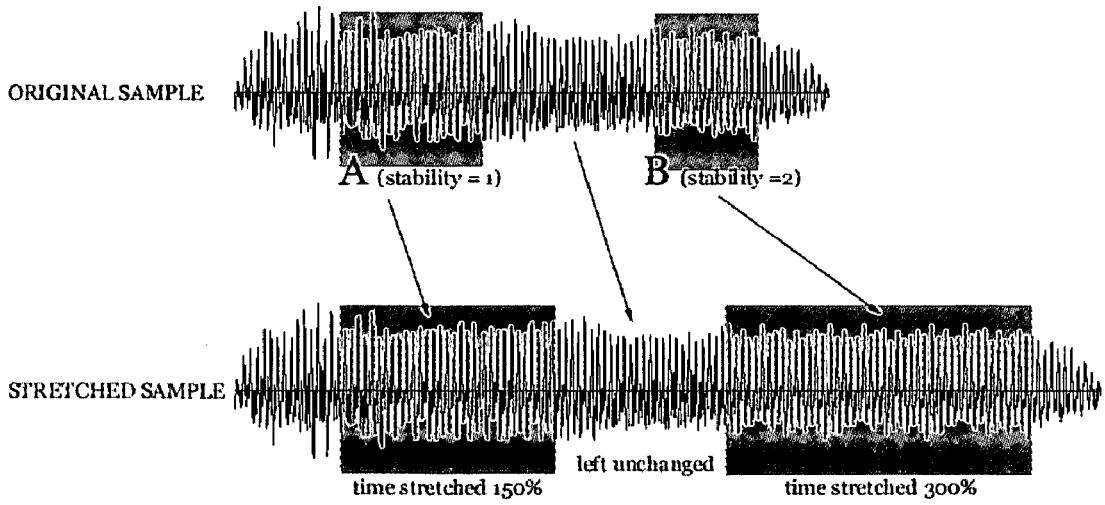
FIG. 8 is a diagram illustrating time stretching by the sample-based sound-producing system of FIG. l.

FIG. 8 illustrates an example of this new time-stretching approach. The upper portion of FIG. 8 represents the audio sample (the above-mentioned syllable " . . . day . . . ") as extracted from the initial audio file. This sample has two zones of stability, labelled A and B. Stability zone A has a stability score of 1, whereas stability zone B has a stability score of 2. If it is desired to time-stretch this sample so that the total duration of the sample is increased by 50%, suitable time-stretching will be applied only to stability zones A and B of the sample, with zone B being stretched twice as much as zone A. The lower portion of FIG. 8 represents the audio sample after time stretching. It will be noted that, although it is aimed to increase the overall duration of the sample by only 50%, the stability zone B is stretched to three times its original length; this is to cater for the fact that some zones of the sample are not stretched at all.

The time-stretching of the stable zones of the audio samples can be performed using a variety of known techniques. However, in the preferred embodiment of the invention, a phase vocoder technique is used to accomplish the desired time stretching. According to this approach, the short-term spectrum of the waveform is analyzed and extra frames are synthesized so as to morph between the waveform's original frames (adding an extra 50 milliseconds approximately every 50 milliseconds). Continuity of phase is assured by using identity phase locking. Phase vocoder techniques and identity phase locking are well-known techniques and so will not be described in detail here.

Even if the played-back audio sample is time-stretched, there will come a time when the user stops holding down the played key. At this time, the time adjuster 80 skips to the release portion of the audio sample's sound. Clearly, when time stretching begins, the user will generally still have his finger on the played key and the system does not know what the maximum duration of the note will be. One approach consists in setting a maximum duration of the note, after time-stretching, to five seconds (for example). The note ceases to sound after that period (analogously to the case for a conventional keyboard).

Although the present invention has been described above with reference to one presently-preferred embodiment thereof, the skilled person will readily recognize that the present invention is not limited by the particularities and details of the above-described embodiment. More particularly, it is to be understood that various modifications can be made in the above-described embodiment, and different embodiments can be produced, without departing from the scope of the present invention as defined in the accompanying claims.

For example, the extracted audio samples need not be stored in digital form (although conversion to digital form is required for certain processes, e.g. time stretching), it is not essential for the extracted audio sample data to be held in the same storage device as the associated meta-data (although it must be possible to identify the audio sample to which particular meta-data relates);

the sample-based sound-producing device need not include the audio-sampler/sample-processor, the Digital-to-Analogue converter need not be integrated into a common module with the time adjuster 80;

the present invention need not be applied to a keyboard-based artificial musical instrument but can be applied to artificial musical instruments of different types (e.g. configured as a saxophone—in which case the "playable domain" corresponds to the different combinations of holes that can be covered by the user's fingers, etc.);

although not mentioned above, the sample-based sound-producing device will often be polyphonic (that is, it will have different channels (voices) enabling the playing of chords); the above-described techniques for generating audio samples from audio files and selecting samples for playback can be applied for each "voice";

when the invention is applied in computer games or the like, the user may not explicitly "play a key" in order to cause an audio sample to be selected and played back, instead sample-selection-and-playback may be triggered by an event or condition occurring during playing of the game—the occurrence of the event or condition can be considered to constitute the selection of a trigger which leads to the play back of an appropriate (assigned) audio sample;

the order of performing certain processing steps may be different from that described above with reference to the flow charts, for example, steps S3, S4 and S5 of FIG. 5 can be performed in any convenient order or in parallel.

Furthermore, the preferred embodiment described above with reference to FIG. 1 relates to a playable sound-producing system in which operation of a trigger (e.g. a note on a keyboard) results in playback of an audio sample which is an extract from an audio file that is mapped to a key (or keys) of the keyboard based on the meta-data of that extract. However, the present invention is not limited to the case where the audio sample is an extract from an audio track, but also covers other cases, such as the case where the audio sample is a whole audio title (e.g. a whole song) that is mapped to a trigger (or several triggers of a sound-producing device based on its meta-data.

Moreover, the preferred embodiment of FIG. 1 relates to a system in which the meta-data for each audio sample is determined automatically by analysis of intrinsic characteristics of the audio samples and determination of meta-data descriptive of those intrinsic characteristics. However, the present invention also provides devices and systems in which the meta-data for each audio sample is pre-existing (i.e. need not be determined by the system). Pre-existing meta-data will often be available, for example, when the source audio files are files in a music database that a user has built up on a personal computer using commercial music browser software.

The invention claimed is:

1. An audio-sampler/sample-processor for preparing audio units for playback in a sample-based sound-producing device, the sound-producing device having a plurality of operable, physical control elements each of which, when operated by a user, causes a sound to be generated based on an audio unit, the audio-sampler/sample-processor comprising:

an input module for receiving an audio file;

an audio-unit extractor for defining a set of audio units, automatically, by sampling within the input audio file, the audio-unit extractor itself setting the start and end points of each audio unit of said set of audio units;

an analyzer for analyzing said audio units, automatically, to determine the acoustic properties thereof and for defining data descriptive of the determined acoustic properties of each audio unit; and a mapping module for defining, automatically, a mapping of extracted audio units to the physical control elements of the sample-based sound-producing device, said mapping being dependent on at least part of said data, determined by the analyzer, descriptive of the acoustic properties of the extracted audio unit and on a mapping function defining a condition holding on audio-unit meta-data;

wherein the audio-sampler/sample-processor is configured such that, when coupled to said sample-based sound-producing device, an user operation of one of said physical control elements of the sample-based sound-producing device causes an output of sound corresponding to an extracted audio unit mapped, by the mapping module, to the one of said physical control elements.

2. An audio-sampler/sample-processor according to claim 1, wherein the analyzer comprises a pitch-detecting module for determining the pitch of an extracted audio unit, and the mapping module is adapted to map an extracted audio unit to one or more of said physical control elements dependent on the pitch of the extracted audio unit.

3. An audio-sampler/sample-processor according to claim 2, wherein the pitch-detecting module comprises a bank of band-pass filters and a harmonic-pattern analyzer for analyzing the pattern of harmonics in the output from the bank of bandpass filters.

4. An audio-sampler/sample-processor according to claim 1, wherein the audio-unit extractor comprises a filter-bank mimicking the frequency resolution and frequency response of the human ear, a spectrum generator for generating the short-term spectrum of the audio unit after passage through said filter-bank, a waveform analyzer for analyzing the energy variations of the music's waveform and a spectrum analyzer for analyzing the maxima and minima of said short-term spectrum.

5. An audio-sampler/sample-processor according to claim 1, and comprising a stability zone detector for detecting zones of spectral stability in the extracted audio units and generating data identifying said zones of spectral stability.

6. An audio-sampler/sample-processor according to claim 1, and comprising output means for outputting to a memory, a network, or a storage medium: data representative of the extracted audio units, data indicative of the mapping of extracted audio units to operable triggers of said sound-producing device and data descriptive of the acoustic properties of the extracted audio units.

7. A playable sample-based sound-producing device, comprising:

an audio-sampler/sample-processor according to claim 1;

a set of operable, physical control elements each of which, when operated by a user, causes a sound to be generated based on an audio unit; and an audio unit selector adapted to respond to operation of one of said physical control elements by selecting for playback one of the audio units extracted from an audio file by said audio sampler/sample-processor, said selected audio unit being mapped to said one of the physical control elements by said mapping means.

8. The playable sample-based sound-producing device according to claim 7, wherein the audio unit selector is adapted to select between a plurality of different extracted audio units mapped to the same one of said physical control elements, said selection comprising matching the acoustic properties of said plurality of different extracted audio units with data indicative of the way in which said physical control element was operated by the user.

9. The playable sample-based sound-producing device according to claim 8, and comprising a time adjuster for causing the duration of playback of an extracted audio unit to differ from the duration of said extracted audio unit, wherein the time adjuster comprises a phase vocoder adapted, in the case where the time adjuster is causing the duration of playback of the extracted audio unit to be longer than the duration of said audio unit, to synthesize extra frames and interpolate said extra frames between frames of said extracted audio unit only in spectrally-stable zones of said extracted audio unit.

* * * * *